US012480192B2

(12) United States Patent
Franklin et al.

(10) Patent No.: US 12,480,192 B2
(45) Date of Patent: Nov. 25, 2025

(54) THICK Al—Mg ALLOY ROLLED PRODUCT SUITABLE FOR ARMOR PLATE APPLICATIONS

(71) Applicant: Constellium Rolled Products Ravenswood, LLC, Ravenswood, WV (US)

(72) Inventors: Jack Franklin, Plymouth, MI (US); Dale Baumgartner, Ravenswood, WV (US); Michael Philbrook, Ravenswood, WV (US); Denise Brandt, Parkersburg, WV (US); Timothy Jackson, Portland, OH (US)

(73) Assignee: Constellium Rolled Products Ravenswood, LLC

( * ) Notice: Subject to any disclaimer, the term of this patent is extended or adjusted under 35 U.S.C. 154(b) by 86 days.

(21) Appl. No.: 18/555,090

(22) PCT Filed: Apr. 13, 2022

(86) PCT No.: PCT/US2022/024571
§ 371 (c)(1),
(2) Date: Oct. 12, 2023

(87) PCT Pub. No.: WO2022/240538
PCT Pub. Date: Nov. 17, 2022

(65) Prior Publication Data

US 2024/0200180 A1 Jun. 20, 2024

Related U.S. Application Data

(60) Provisional application No. 63/174,882, filed on Apr. 14, 2021.

(51) Int. Cl.

| | |
|---|---|
| ***C22C 21/06*** | (2006.01) |
| ***C22F 1/047*** | (2006.01) |
| ***F41H 5/04*** | (2006.01) |

(52) U.S. Cl.
CPC ..... *C22F 1/047* (2013.01); *C22C 21/06* (2013.01); *F41H 5/045* (2013.01)

(58) Field of Classification Search
None
See application file for complete search history.

(56) References Cited

U.S. PATENT DOCUMENTS 4,469,537 A 9/1984 Ashton et al.
9,255,315 B2 * 2/2016 Kröpfl ..... B22D 21/007
(Continued)

FOREIGN PATENT DOCUMENTS

WO 2007115617 A1 10/2007
WO 2008098743 A1 8/2008
(Continued)

OTHER PUBLICATIONS

PCT International Search Report and Written Opinion for International Application No. PCT/US2022/024571, issued Jan. 16, 2023.
(Continued)

*Primary Examiner* — Daniel J. Schleis
(74) *Attorney, Agent, or Firm* — McBee Moore & Vanik IP, LLC

(57) ABSTRACT

The disclosure relates to an aluminum alloy plate having a final thickness of 3 inch or more, and a method for manufacturing same. In the method, an aluminum alloy with a chemical composition of in weight percent: Mg 4.0 to 5.2, Mn 0.4 to 1.0, Zn≤0.3, Zr≤0.3, Cr≤0.3, Ti≤0.3, Fe<0.50, Si<0.45, Cu<0.25, other elements and unavoidable impurities each <0.05 total <0.20 balance aluminum, is cast, preheated and/or homogenized, hot rolled, cold rolled with a cold rolling reduction of 3 to 10%, and stretched directly after cold rolling with a permanent elongation of 0.7 to 5% in the direction of stretching.

16 Claims, 1 Drawing Sheet

(56) References Cited

U.S. PATENT DOCUMENTS

| | | | |
|---|---|---|---|
| 2011/0017055 | A1 | 1/2011 | Mooy et al. |
| 2015/0284831 | A1 | 10/2015 | Kröpfl et al. |
| 2015/0360269 | A1 | 12/2015 | Meyer et al. |

FOREIGN PATENT DOCUMENTS

| | | | |
|---|---|---|---|
| WO | 2011011744 | A1 | 1/2011 |
| WO | 2014114625 | A1 | 7/2014 |

OTHER PUBLICATIONS

Jones Tyrone et al., "The Ballistic and Corrosion Evaluation of Magnesium Elektron E675 vs. Baseline Magnesium Alloy AZ31B and Aluminum Alloy 5083 for Armor Applications", Jun. 1, 2011, pp. 1-52.

* cited by examiner

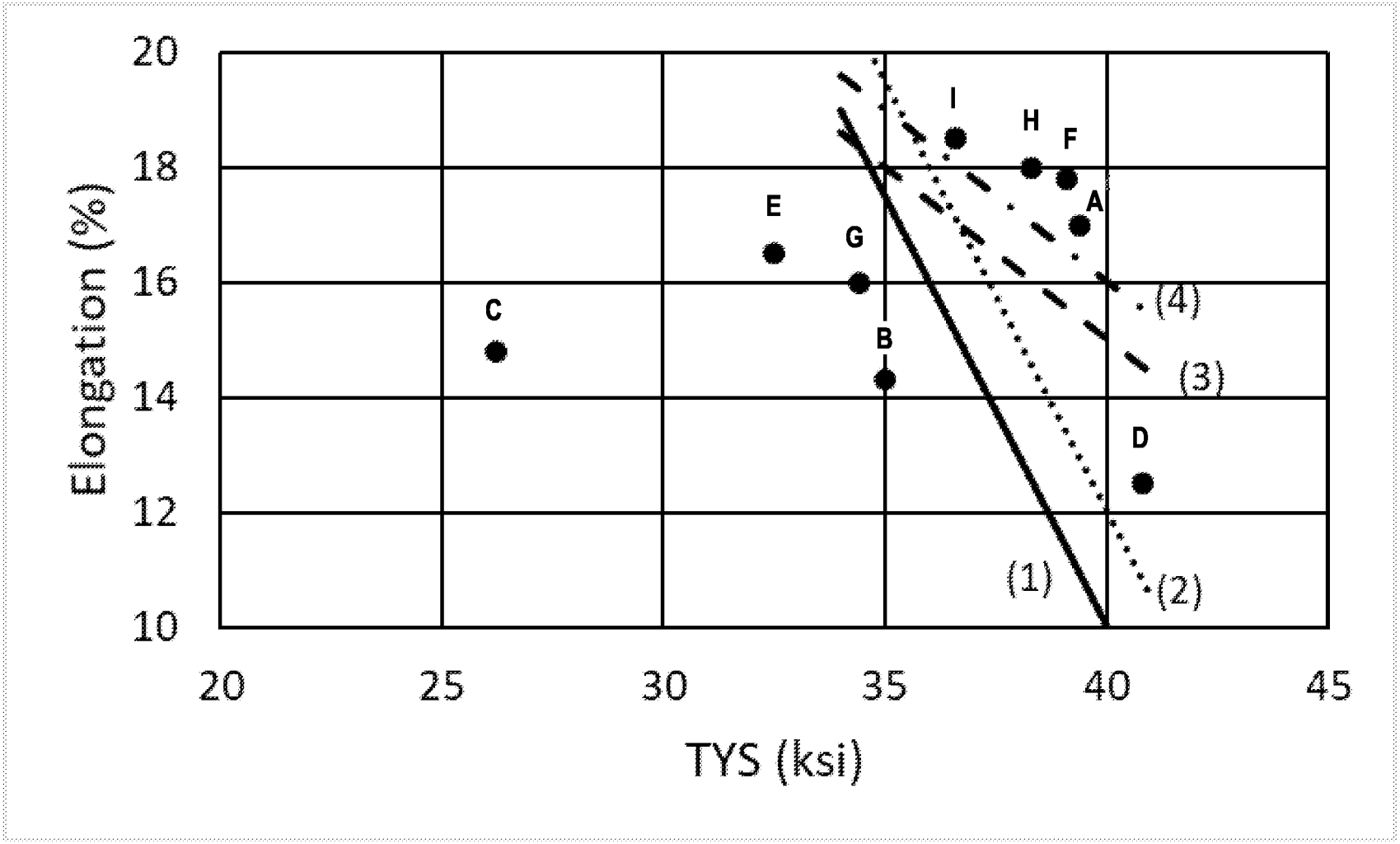
Elongation (%)
20
18
16
14
12
10
TYS (ksi)
20
25
30
35
40
45
A
B
C
D
E
F
G
H
I
(1)
(2)
(3)
(4)

THICK Al—Mg ALLOY ROLLED PRODUCT SUITABLE FOR ARMOR PLATE APPLICATIONS

CROSS-REFERENCE TO RELATED APPLICATIONS

This patent application claims the benefit of U.S. Provisional Patent Application No. 63/174,882, filed 14 Apr. 2021. The disclosure of the priority application is incorporated in its entirety herein by reference. This application is the National Stage entry of International Application No. PCT/US2022/024571, filed 13 Apr. 2022.

FIELD

This disclosure pertains to an aluminum alloy plate product having a gauge of 3 inch or more. More particularly, this disclosure pertains to AlMg alloys that are suitable for armor plate and marine applications, yet have improved performance properties, particularly improved strength-corrosion balance.

DESCRIPTION OF RELATED ART

Because of their light weight, aluminum alloys have found wide use in military applications and marine applications. The light weight of aluminum allows for improved performance and ease of transporting equipment, including air transport of military vehicles. In some vehicles it is advisable to provide shielding or protection against assault, by providing armor plate to protect the occupants of the vehicle. Aluminum has enjoyed substantial use as armor plate, and there are a number of armor plate specifications for the use of different aluminum alloys. Aluminum alloys AA5083 and AA5456 have been used as armor plates for thicknesses up to 3 inch, as explained in the U.S. Military Specification for armor plate MIL-DTL-46027K (March 2015).

The compositional ranges for AA5083 are, in weight percent: Mg 4.0 to 4.9, Mn 0.40 to 1.0, Cr 0.05 to 0.25, Si max. 0.40, Fe max. 0.40, Cu max. 0.10, Zn max. 0.25, Ti max. 0.15, impurities each element <0.05, total <0.15, balance aluminum.

The compositional ranges for AA5456 are, in weight percent: Mg 4.7 to 5.5, Mn 0.50 to 1.0, Cr 0.05 to 0.20, Si max. 0.25, Fe max. 0.40, Cu max. 0.10, Zn max. 0.25, Ti max. 0.20, impurities each element <0.05, total <0.15, balance aluminum.

The patent application WO 2008/098743 discloses an aluminum alloy plate having a gauge of 10 mm or more and the aluminum alloy having a chemical composition including, in weight percent: Mg 4.0 to 6.0, Mn 0.2 to 1.4, Zn 0.9 max., Zr<0.3, Cr<0.3, Sc<0.5, Ti<0.3, Fe<0.5, Si<0.45, Ag<0.4, Cu<0.25, other elements and unavoidable and wherein the alloy plate is obtained by a manufacturing process including casting, preheating and/or homogenization, hot rolling, a first cold working operation, an annealing treatment at a temperature of less than 350° C., followed by a second cold working operation.

The patent application WO2014114625 discloses a method of forming an AlMg alloy armor plate product, and comprising the steps of: (i) providing a plate product having a gauge of at least 10 mm and a chemical composition, in wt. %: Mg 2.5% to 6%, Mn 0 to 1.2%, Sc 0 to 1%, Ag 0 to 0.5%, Zn 0 to 2%, Cu 0 to 2%, Li 0 to 3%, optionally at least one or more elements selected from the group consisting of (Zr 0.03% to 0.4%, Cr 0.03% to 0.4%, and Ti 0.005% to 0.3%), Fe 0 to 0.4%, Si 0 to 0.25%, inevitable impurities and balance aluminum, and (ii) shaping said alloy plate at a temperature in a range of 200° C. to 400° ° C. to obtain a predetermined two- or three-dimensional formed structure.

The patent application WO2007115617A1 discloses an aluminum alloy plate having a gauge of 10 mm or more and the aluminum alloy having a chemical composition comprising, in weight percent: Mg 4.95 to 6.0; Mn 0.45 to 1.2; Zn 0.20 to 0.90; Zr 0.05 to 0.25; Cr<0.3; Sc<0.5; Ti<0.3; Fe<0.5; Si<0.45; Ag<0.4; Cu<0.25; other elements and unavoidable impurities each <0.05, total <0.20, balance aluminum.

The patent application WO2011/011744 discloses 5xxx aluminum alloys and products made therefrom that achieve an improved combination of properties due to the presence of copper. In one embodiment, the new 5xxx aluminum alloy products are able to achieve an improved combination of properties by solution heat treatment.

The U.S. Pat. No. 4,469,537 discloses a method of producing aluminum alloy armor plate, comprising: A. Providing an ingot consisting of about 5.0 to 6.5% magnesium and about 0.60 to 1.20% manganese, the total of magnesium and manganese being in the range of about 6.0 to 6.7%, the balance being aluminum and impurities and incidental elements; B. Hot rolling the ingot into plate; and C. Cold rolling said plate to a cold rolled reduction of at least about 19%.

The products disclosed in these patent or patent applications have typically a thickness of less than 3 inch. However, as vehicles are becoming larger the armored vehicles manufacturers are having to stack up multiple plates in order to achieve their desired shapes. This stacking of plates requires the need to weld material together. Along with this being time consuming and costly from a production standpoint, the welding of weld seams also introduces areas in the final vehicle which are weaker than the base material and can have corrosion issues. Therefore it is desirable to the OEMs to machine these areas out of a reduced number of thicker plates.

Providing thicker product should however not compromise the mechanical and corrosion properties in order to meet the requirements in the MIL-DTL and maintain protection and survivability to the vehicle occupants as well as maintain structure integrity in corrosive environment. As is known to those skilled in the art, increasing the thickness of aluminum rolled products without compromising such properties is a difficult task because many properties such as casting structure, primary phase size, texture, grain size may be related to process parameters such as casting thickness, thermal treatments, rolling reductions, cold working type, and so on.

A typical method to transform lower thickness products made of Al—Mg alloys comprises casting, pre-heat to roll, hot rolling to intermediate gauge, about 20% cold rolling to finish gauge. However, this rolling-only method cannot be easily adapted for thicker products due to machine limitation.

A problem that the present disclosure intends to solve is to provide thick 5000 series alloy products that have very good strength elongation balance, yet exhibits good corrosion performance and high resistance to incoming kinetic energy projectiles.

SUMMARY

An object of the present disclosure is a method of manufacturing an aluminum alloy plate having a final thickness of 3 inch or more, the method comprising, consisting essential of, or consisting of the following successive steps:

(a) casting an aluminum alloy having a chemical composition comprising, consisting essentially of, or consisting of, in weight percent:

Mg 4.0 to 5.2
Mn 0.4 to 1.0
Zn≤0.3
Zr≤0.3
Cr≤0.3
Ti≤0.3
Fe<0.50
Si<0.45
Cu<0.25
other elements and unavoidable impurities each <0.05 total <0.20 balance aluminum, (b) preheating and/or homogenization,
(c) hot rolling,
(d) cold rolling with a cold rolling reduction of 3 to 10%,
(e) stretching directly after cold rolling with a permanent elongation of 0.7 to 5% in the direction of stretching.

Another object of the disclosure is an aluminum alloy plate having a final thickness of 3 inch or more obtained by the method of the disclosure comprising, consisting essentially of, or consisting of, in weight percent:

Mg 4.0 to 5.2
Mn 0.4 to 1.0
Zn≤0.3
Zr≤0.3
Cr≤0.3
Ti≤0.3
Fe<0.50
Si<0.45
Cu<0.25
other elements and unavoidable impurities each <0.05 total <0.20 balance aluminum.

Yet another object of the disclosure is the use of an aluminum alloy plate according to the disclosure as armor plate in an armored vehicle.

Yet another object of the disclosure is the use of an aluminum alloy plate according to the disclosure as plate for marine construction.

BRIEF DESCRIPTION OF THE DRAWINGS

FIG. 1 shows the tensile yield strength balance for example 1.

DETAILED DESCRIPTION OF THE PREFERRED EMBODIMENTS

Unless otherwise indicated, all indications concerning the chemical composition of alloys are expressed as a percentage by weight based on the total weight of the alloy. The expression 1.4 Cu means that the copper content expressed in % by weight is multiplied by 1.4. The designation of the alloys is made in accordance with the regulations of The Aluminum Association, known to those skilled in the art.

The static mechanical properties in tension, in other words the ultimate tensile strength UTS, the conventional tensile yield strength at 0.2% elongation TYS, and the elongation at break A %, are determined by a tensile test according to standard ASTM E8 and ASTM B557.

Unless stated otherwise, the definitions of standard EN 12258 (2012) apply.

The present inventors have found that by combining specific cold working steps after hot rolling of a specific Al—Mg—Mn alloy the problem is solved and thick rolled products having a very good strength elongation balance and yet good corrosion performance are obtained. By thick rolled products it is meant rolled products having a thickness of at least 3 inch. Preferably the thick rolled products have a final thickness of at least 4 inch, or 4.5 inch or even 4.8 inch. A preferred maximum final thickness is 12 inch or 11 inch. In an embodiment the final thickness of the products is from 4.5 inch to 8.5 inch. In another embodiment the final thickness of the products is from 6 inch to 11 inch. In another embodiment, the lower limit of thickness may be about 3 inches, about 3.5 inches, about 4 inches, about 4.5 inches, about 4.8 inches, about 5 inches, about 5.5 inches, about 6 inches, about 6.5 inches, about 7 inches, about 7.5 inches, about 8 inches, about 8.5 inches, about 9 inches, about 9.5 inches, about 10 inches, about 10.5 inches, about 11 inches, or about 11.5 inches; the upper limit of thickness may be about 3.5 inches, about 4 inches, about 4.5 inches, about 4.8 inches, about 5 inches, about 5.5 inches, about 6 inches, about 6.5 inches, about 7 inches, about 7.5 inches, about 8 inches, about 8.5 inches, about 9 inches, about 9.5 inches, about 10 inches, about 10.5 inches, about 11 inches, about 11.5 inches, or about 12 inches.

According to the disclosure, an Al—Mg—Mn alloy is cast comprising, consisting essentially of, or consisting of in weight percent: Mg 4.0 to 5.2, Mn 0.4 to 1.0, Zn≤0.3., Zr≤0.3, Cr≤0.3, Ti≤0.3, Fe<0.50, Si<0.45, Cu<0.25, other elements and unavoidable impurities each <0.05, total <0.20, balance aluminum. Casting is preferably carried out by DC casting and the alloy is cast in the shape of a slab which has preferably a thickness of at least about 14 inches and preferably of at least about 16 inches. In an embodiment, the slab has a thickness of at least about 14 inches, at least about 14.5 inches, at least about 15 inches, at least about 15.5 inches, or at least about 16 inches.

Preferably, the Mg content is at least 4.1 wt. %. A maximum Mg content of 5.0 wt. % may be advantageous. In an embodiment the Mg content is from 4.4 to 4.8 wt. %. In another embodiment wherein corrosion resistance is maximized the Mg content is from 4.0 to 4.5 wt. %. In another embodiment, the lower limit of Mg may be about 4.0 wt. %, about 4.1 wt. %, about 4.2 wt. %, about 4.3 wt. %, about 4.4 wt. %, about 4.5 wt. %, about 4.6 wt. %, about 4.7 wt. %, about 4.8 wt. %, about 4.9 wt. %, about 5.0 wt. %, or about 5.1 wt. %; the upper limit may be about 4.1 wt. %, about 4.2 wt. %, about 4.3 wt. %, about 4.4 wt. %, about 4.5 wt. %, about 4.6 wt. %, about 4.7 wt. %, about 4.8 wt. %, about 4.9 wt. %, about 5.0 wt. %, about 5.1 wt. %, or about 5.2 wt. %.

Preferably, the Mn content is at least 0.5 wt. %. A maximum Mn content of 0.9 wt. % may be advantageous. In an embodiment the Mn content is from 0.6 to 0.9 wt. %. In another embodiment, the lower limit of Mn may be about 0.4 wt. %, about 0.45 wt. %, about 0.5 wt. %, about 0.55 wt. %, about 0.6 wt. %, about 0.65 wt. %, about 0.7 wt. %, about 0.75 wt. %, about 0.8 wt. %, about 0.85 wt. %, about 0.9 wt. %, or about 0.95 wt. %; the upper limit may be about 0.45 wt. %, 0.5 wt. %, about 0.55 wt. %, about 0.6 wt. %, about 0.65 wt. %, about 0.7 wt. %, about 0.75 wt. %, about 0.8 wt. %, about 0.85 wt. %, about 0.9 wt. %, about 0.95 wt. %, or about 1.0 wt. %. The strength elongation balance maybe improved in relation to the Mg and Mn content. In an embodiment the sum of Mg and Mn content is from 4.70 to 5.60 wt. % and preferably from 4.80 to 5.50 wt. %. In another embodiment, the lower limit of the sum of Mg and Mn content may be about 4.70 wt. %, about 4.75 wt. %, about 4.80 wt. %, about 4.85 wt. %, about 4.90 wt. %, about 4.95 wt. %, about 5.00 wt. %, about 5.05 wt. %, about 5.10 wt. %, about 5.15 wt. %, about 5.20 wt. %, about 5.25 wt. %, about 5.30 wt. %, about 5.35 wt. %, about 5.40 wt. %, about 5.45 wt. %, about 5.50 wt. %, or about 5.55 wt. %; the upper limit may be about 4.75 wt. %, about 4.80 wt. %, about 4.85 wt. %, about 4.90 wt. %, about 4.95 wt. %, about 5.00 wt. %, about 5.05 wt. %, about 5.10 wt. %, about 5.15 wt. %, about 5.20 wt. %, about 5.25 wt. %, about 5.30 wt. %, about 5.35 wt. %, about 5.40 wt. %, about 5.45 wt. %, about 5.50 wt. %, about 5.55 wt. %, or about 5.60 wt. %.

Cu and Zn may improve strength and can also influence corrosion properties. Cu is restricted to less than 0.25 wt. % and preferably to less than 0.15 wt. % and more preferably to less than 0.05 wt. %. In an embodiment, the lower limit of Cu may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.16 wt. %, about 0.17 wt. %, about 0.18 wt. %, about 0.19 wt. %, about 0.20 wt. %, about 0.21 wt. %, about 0.22 wt. %, about 0.23 wt. %, or about 0.24 wt. %; the upper limit may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.20 wt. %, about 0.21 wt. %, about 0.22 wt. %, about 0.23 wt. %, about 0.24 wt. %, or about 0.25 wt. %. Zn may be added up to 0.3 wt. %. In an embodiment wherein corrosion resistance is maximized the Zn content is at least 0.15 wt. % and preferably at least 0.20 wt. %. In another embodiment Zn is less than 0.20 wt. % and even less than 0.15 wt. %. In an embodiment, the lower limit of Zn may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.16 wt. %, about 0.17 wt. %, about 0.18 wt. %, about 0.19 wt. %, about 0.20 wt. %, about 0.21 wt. %, about 0.22 wt. %, about 0.23 wt. %, about 0.24 wt. %, about 0.25 wt. %, about 0.26 wt. %, about 0.27 wt. %, about 0.28 wt. %, or about 0.29 wt. %; the upper limit may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.20 wt. %, about 0.21 wt. %, about 0.22 wt. %, about 0.23 wt. %, about 0.24 wt. %, about 0.25 wt. %, about 0.26 wt. %, about 0.27 wt. %, about 0.28 wt. %, about 0.29 wt. %, or about 0.30 wt. %. Zr, Cr and Ti may influence grain size control and corrosion properties.

Zr may be added up to 0.3 wt. %. In an embodiment Zr is less than 0.05 wt. %. In an embodiment, the lower limit of Zr may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.16 wt. %, about 0.17 wt. %, about 0.18 wt. %, about 0.19 wt. %, about 0.20 wt. %, about 0.21 wt. %, about 0.22 wt. %, about 0.23 wt. %, about 0.24 wt. %, about 0.25 wt. %, about 0.26 wt. %, about 0.27 wt. %, about 0.28 wt. %, or about 0.29 wt. %; the upper limit may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.16 wt. %, about 0.17 wt. %, about 0.18 wt. %, about 0.19 wt. %, about 0.20 wt. %, about 0.21 wt. %, about 0.22 wt. %, about 0.23 wt. %, about 0.24 wt. %, about 0.25 wt. %, about 0.26 wt. %, about 0.27 wt. %, about 0.28 wt. %, about 0.29 wt. %, or about 0.30 wt. %. Cr may be added up to 0.3 wt. %. In an embodiment Cr is from 0.06 wt. % to 0.21 wt. % and preferably from 0.07 to 0.11 wt. %. In an embodiment, the lower limit of Cr may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.16 wt. %, about 0.17 wt. %, about 0.18 wt. %, about 0.19 wt. %, about 0.20 wt. %, about 0.21 wt. %, about 0.22 wt. %, about 0.23 wt. %, about 0.24 wt. %, about 0.25 wt. %, about 0.26 wt. %, about 0.27 wt. %, about 0.28 wt. %, or about 0.29 wt. %; the upper limit may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.20 wt. %, about 0.21 wt. %, about 0.22 wt. %, about 0.23 wt. %, about 0.24 wt. %, about 0.25 wt. %, about 0.26 wt. %, about 0.27 wt. %, about 0.28 wt. %, about 0.29 wt. %, or about 0.30 wt. %.

Ti may be added up to 0.3 wt. %. In an embodiment Ti is from 0.005 wt. % to 0.10 wt. % and preferably from 0.01 to 0.05 wt. %. In an embodiment, the lower limit of Ti may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.16 wt. %, about 0.17 wt. %, about 0.18 wt. %, about 0.19 wt. %, about 0.20 wt. %, about 0.21 wt. %, about 0.22 wt. %, about 0.23 wt. %, about 0.24 wt. %, about 0.25 wt. %, about 0.26 wt. %, about 0.27 wt. %, about 0.28 wt. %, or about 0.29 wt. %; the upper limit may be 0 wt. %, about 0.01 wt. %, about 0.02 wt. %, about 0.03 wt. %, about 0.04 wt. %, about 0.05 wt. %, about 0.06 wt. %, about 0.07 wt. %, about 0.08 wt. %, about 0.09 wt. %, about 0.10 wt. %, about 0.11 wt. %, about 0.12 wt. %, about 0.13 wt. %, about 0.14 wt. %, about 0.15 wt. %, about 0.20 wt. %, about 0.21 wt. %, about 0.22 wt. %, about 0.23 wt. %, about 0.24 wt. %, about 0.25 wt. %, about 0.26 wt. %, about 0.27 wt. %, about 0.28 wt. %, about 0.29 wt. %, or about 0.30 wt. %.

Fe and Si are considered impurities that should be limited to less than 0.50 wt. % and less than 0.45 wt. %, respectively, preferably to 0.35 wt. % and 0.25 wt. %, respectively. In order to facilitate recycling and keep production costs low, it is advantageous to maintain a minimum content of Fe and Si of 0.10 wt. % and 0.05 wt. %, respectively. In an embodiment, the lower limit of Fe may be 0 wt. %, about 0.05 wt. %, about 0.10 wt. %, about 0.15 wt. %, about 0.2 wt. %, about 0.25 wt. %, about 0.30 wt. %, about 0.35 wt. %, about 0.40 wt. %, or about 0.45 wt. %; the upper limit may be 0 wt. %, about 0.05 wt. %, about 0.10 wt. %, about 0.15 wt. %, about 0.20 wt. %, about 0.25 wt. %, about 0.30 wt. %, about 0.35 wt. %, about 0.40 wt. %, about 0.45 wt. %, or about 0.50 wt. %. In an embodiment, the lower limit of Si may be 0 wt. %, about 0.05 wt. %, about 0.10 wt. %, about 0.15 wt. %, about 0.2 wt. %, about 0.25 wt. %, about 0.30 wt. %, about 0.35 wt. %, or about 0.40 wt. %; the upper limit may be 0 wt. %, about 0.05 wt. %, about 0.10 wt. %, about 0.15 wt. %, about 0.20 wt. %, about 0.25 wt. %, about 0.30 wt. %, about 0.35 wt. %, about 0.40 wt. %, or about 0.45 wt. %.

Other elements and unavoidable impurities are each less than 0.05 wt. % less than 0.20 wt. %, the balance is aluminum After casting, the alloy is preheated and/or homogenized preferably at a temperature of at least 896° F. (480° C.), in single or multiple steps, prior to hot rolling.

Preferably, the temperature should not exceed 1004° F. (540° C.) in order to avoid incipient melting. Preferably the alloy is preheated at least 2 hours at least 932° F. (500° C.).

The alloy is hot rolled to an intermediate thickness adapted to the targeted final thickness. The hot rolling reduction is preferably at least about 30% of the initial (before any hot rolling) thickness, preferably at least about 50%. Hot rolling is preferably carried out using a reversing hot mill which rolls the metal back and forth to squeeze its thickness down. Thus, the initial hot rolling can be done in increments using different rolling mills. It can also include conventional reheating procedures at around 850° F. (454° C.) or so between the rolling passes to replace lost heat. The hot rolling exit temperature is preferably at least 650° F. (343° C.) and more preferably at least 700° F. (371° C.).

Following the hot rolling operation, the alloy product is cold rolled with a cold roll reduction in a range of 3% to 10%, preferably in a range of 5% to 8%. In an embodiment, the lower limit of cold roll reduction may be about 3%, about 3.5%, about 4%, about 4.5%, about 5%, about 5.5%, about 6%, about 6.5%, about 7%, about 7.5%, about 8%, about 8.5%, about 9%, or about 9.5%; the upper limit may be about 3.5%, about 4%, about 4.5%, about 5%, about 5.5%, about 6%, about 6.5%, about 7%, about 7.5%, about 8%, about 8.5%, about 9%, about 9.5%, or about 10%.

The cold rolling operation is directly followed, i.e. in particular without any intermediate heat treatment, by stretching with a permanent elongation in the direction of stretching in a range of 0.7% to 5% and preferably in a range of 0.9% to 3%. In an embodiment, the lower limit may be about 0.7%, about 0.9%, about 1.0%, about 1.5%, about 2.0%, about 2.5%, 3%, about 3.5%, about 4%, about 4.5%; the upper limit may be about 0.9%, about 1.0%, about 1.5%, about 2.0%, about 2.5%, 3%, about 3.5%, about 4%, about 4.5%, or about 5.0%. It has been found that surprisingly the cold rolling operation in a range of 3% to 10% directly followed by the stretching operation in a range of 0.7% to 5% results in thick rolled products having an improved balance of strength and elongation compared to products that did not receive such a treatment.

Preferably the product of the disclosure exhibit at mid-thickness and in the longitudinal direction TYS and elongation A % such as elongation A % is at least −1.5 TYS+70 and preferably −1.5 TYS+72, wherein TYS is provided in ksi. In an embodiment, wherein the preferred Mg+Mn condition is fulfilled, the product of the disclosure exhibit at mid-thickness and in the longitudinal direction TYS and elongation A % such as elongation A % is at least −0.6 TYS+39 and preferably −0.6 TYS+40, wherein TYS is provided in ksi.

Corrosion properties of the products of the disclosure are such as in a H116 temper ASTM G66 rating is preferably at least PB. In an embodiment wherein the Zn content is at least 0.15 wt. % and preferably at least 0.20 wt. %, and advantageously wherein the Mg content is from 4.0 to 4.5 wt. %, in a H116 temper ASTM G66 rating is at least PA.

Products of the disclosure exhibit preferably in a H128 temper an ASTM G67 weight loss less than 15 mg/cm$^2$.

A further aspect of the disclosure relates to the use of the thick product of the disclosure as armor plate typically as single piece machined sub-sections and/or as structural components and/or as hulls. These uses can be implemented on typical armored vehicles, in particular in military vehicles such as tracked or wheeled combat vehicles, armored personnel carriers, armored support systems, amphibious assault systems, advanced assault amphibious vehicles, or armed robotic vehicles. When applied in such armored vehicles it will be preferably in the form of an integrally machined armor or structural component or as single piece hulls. Hang-on armor plate is also possible for the aluminum alloy plate according to this disclosure, but is not the most preferred application. The ability to stop piercing projectiles is designated by the letters "AP" ("Armor Piercing") and characterize resistance to perforation. During this test, the armor panels are the target of a spindle shape projectile. In each test type, several geometries are used in the projectile according to the thickness of the test panel and the nature of the threats that said armor panel is intended to protect. A typical AP tests is carried out with 0.5" caliber AP M2 bullets.

The ability to stop bullets and absorb their kinetic energy is quantified by a parameter called "V50 ballistic limit" having a speed dimension. V50 is defined for example in MIL-STD-662 (1997) standard: it is the velocity at which the probability of penetration of an armor material is 50%. It is established by calculating the average of speeds attained by the projectiles on impact resulting from taking the same number of results having the highest speeds corresponding to a partial penetration and results having the lowest speeds corresponding to a complete penetration. A complete penetration occurs when the impacting projectile or any fragment (of the projectile or of the test specimen) perforates a thin witness plate located behind the test specimen. Products according to the disclosure in the thickness range from 3 inch to 4 inch exhibit preferably a V50 ballistic limit with a 0.5" caliber AP M2 bullet, expressed in foot per second, of at least 1481.2*ln(thickness)+1033.5, where the product thickness is expressed in inch, * means multiplied by and ln means natural logarithm. For plates greater than 4 inch thick we do the following the armor piercing behavior is characterized in the following way: the center 4 inches of the plate is prepared by machining out the surface evenly from both sides; the resulting 4 inch material is tested like a standard sample. The products of the disclosure with a thickness from 4.001 to 6 inches have preferably a V50 ballistic limit, with a 0.5" caliber AP M2 bullet, at least equal to the V50 ballistic limit, with a 0.5" caliber AP M2 bullet, of a 4 inch plate according to the disclosure minus 70 feet/sec. The products of the disclosure with a thickness from 6.001 to 11 inches have preferably a V50 ballistic limit, with a 0.5" caliber AP M2 bullet, at least equal to the V50 ballistic limit, with a 0.5" caliber AP M2 bullet, of a 4 inch plate according to the disclosure minus 100 feet/sec.

A further aspect of the disclosure relates to the use of the thick product of the disclosure as plate for marine construction typically as single piece machined sub-sections and/or as structural components and/or as hulls. These uses can be implemented on typical salt water fairing military vessels, such as aircraft carriers, amphibious assault/command/ship or transport ships, submarines, frigate, cruisers, and destroyers. The disclosure also relates to the usage of thick plate in civilian marine applications, both salt water and fresh water, such as cargo and transport vessels, pleasure boats and pleasure craft, barges, ferry, speed boats, jet propelled craft, tugs, catamarans, and lifeboats. When applied in marine applications it will be preferably in the form of an integrally machined structural component or as single piece hulls. Hang-on components and smaller parts is possible for the aluminum alloy plate according to this disclosure, but is not the most preferred use.

The term "about" when used in connection with a measurable numerical variable, refers to the indicated value of the variable and to all values of the variable that are within the experimental error of the indicated value or within +10 percent of the indicated value, whichever is greater.

The disclosure will now be illustrated with reference to the following non-limiting example. The examples are intended to be illustrative only and not intended to limit the disclosure.

EXAMPLE

Aluminum plate with various thicknesses were prepared with several different methods. The mechanical properties were characterized at mid-thickness as for such thick products this appears to be the location of the lowest mechanical properties.

The following slabs having a thickness between 16 and 24 inches were cast by DC casting. The composition is provided in Table 1.

TABLE 1

| | Composition in weight %. | | | | | | | | |
|---|---|---|---|---|---|---|---|---|---|
| | Mg | Mr | Zn | Zr | Cr | Ti | Fe | Si | Cu |
| A | 4.50 | 0.64 | 0.22 | <0.01 | 0.09 | 0.02 | 0.28 | 0.15 | 0.05 |
| B | 4.71 | 0.87 | 0.05 | <0.01 | 0.08 | 0.02 | 0.21 | 0.07 | 0.03 |
| C | 4.85 | 0.91 | 0.07 | <0.01 | 0.09 | 0.02 | 0.16 | 0.06 | 0.04 |
| D | 4.69 | 0.85 | 0.08 | <0.01 | 0.08 | 0.02 | 0.18 | 0.07 | 0.03 |
| E | 4.84 | 0.84 | 0.05 | <0.01 | 0.09 | 0.01 | 0.19 | 0.08 | 0.03 |
| F | 4.51 | 0.87 | 0.09 | <0.01 | 0.07 | 0.02 | 0.20 | 0.08 | 0.04 |
| G | 4.79 | 0.86 | 0.05 | <0.01 | 0.07 | 0.01 | 0.17 | 0.08 | 0.02 |
| H | 4.19 | 0.61 | 0.23 | <0.01 | 0.09 | 0.02 | 0.26 | 0.17 | 0.05 |
| I | 4.65 | 0.80 | 0.07 | <0.01 | 0.07 | 0.01 | 0.15 | 0.08 | 0.02 |

After casting the ingots were scalped. re-heated to about 970° F. (520° C.) for 2 hours and hot rolled to an intermediate thickness. The detailed processing conditions after hot rolling are provided in Table 2. The processing conditions of examples A, D, F, H and I are according to the disclosure. Examples B and F were hot rolled directly to the final thickness with warm temperature in the range of 400 to 600° F. All the other examples were hot rolled to an intermediate thickness provided in Table 2, with an exit hot rolling temperature of at least 650° F. (343° C.). For example E no stretching was applied.

TABLE 2

| | Processing route | | | | |
|---|---|---|---|---|---|
| | Intermediate thickness | Final thickness (inch) | Warm rolling exit (T°) | Cold rolling | Stretching |
| A | 5.4 | 5.0 | — | 6.15% | 2.25% |
| B | — | 5.0 | 400-600 | — | 2% |
| C | — | 6.5 | 400-600 | — | — |
| D | 6.5 | 6.0 | — | 6.82% | 1.50% |
| E | 8.0 | 6.5 | — | 18.7% | — |
| F | 8.1 | 7.4 | — | 7.09% | 0.96% |
| G | 5.4 | 5.0 | — | 5.45% | 0.50% |

TABLE 2-continued

| | Processing route | | | | |
|---|---|---|---|---|---|
| | Intermediate thickness | Final thickness (inch) | Warm rolling exit (T°) | Cold rolling | Stretching |
| H | 6.5 | 6.0 | | 7.44% | 1.75% |
| I | 8.7 | 8.0 | | 6.57% | 2.25% |

The mechanical properties were characterized at mid-thickness in the longitudinal direction. The results are provided in Table 3.

TABLE 3

| | mechanical properties | | |
|---|---|---|---|
| | UTS (ksi) | TYS (ksi) | Elongation A % |
| A | 45.0 | 39.4 | 17.0 |
| B | 48.0 | 35.0 | 14.3 |
| C | 45.7 | 26.2 | 14.8 |
| D | 48.3 | 40.8 | 12.5 |
| E | 46.3 | 32.5 | 16.5 |
| F | 46.8 | 39.1 | 17.8 |
| G | 47.1 | 34.4 | 16.0 |
| H | 44.0 | 38.3 | 18.0 |
| I | 46.5 | 36.6 | 18.5 |

The mechanical properties are also presented in FIG. 1. The minimum elongation from different embodiments are also represented:

(1) A %=−1.5 TYS+70

(2) A %=−1.5 TYS+72

(3) A %=−0.6 TYS+39

(4) A %=−0.6 TYS+40

The corrosion properties of examples H and I were characterized according to ASTM G66. ASTM G67 and ASTM B928 in H116 and H128 tempers.

The results are provided in Table 4.

TABLE 4

| | corrosion properties | | | |
|---|---|---|---|---|
| | Temper | ASTM G66 Rating | ASTM G67 ($mg/cm^2$) | Phosphoric etch (per ASTM B928) |
| H | H116 | PA | 2.1 | PASS |
| I | H116 | PB | 2.9 | PASS |
| I | H128 | PA | 14.9 | PASS |

The invention claimed is:

1. A method of manufacturing an aluminum alloy plate having a final thickness of 3 inch or more, the method comprising successively:

(a) casting an aluminum alloy having a chemical composition comprising, in weight percent:

Mg 4.0 to 5.2

Mn 0.4 to 1.0

Zn≤0.3

Zr≤0.3

Cr≤0.3

Ti≤0.3

Fe<0.50

Si<0.45

Cu<0.25 other elements and unavoidable impurities each <0.05 total <0.20 balance aluminum, wherein the sum of Mg and Mn content is from 4.70 to 5.50 wt. %, (b) preheating and/or homogenization, (c) hot rolling, (d) cold rolling with a cold rolling reduction of 3 to 10%, (e) stretching directly after cold rolling with a permanent elongation of 0.7 to 5% in the direction of stretching.

2. A method according to claim 1 wherein the maximum Mg content is 5.0 wt. %.

3. A method according to any one of claim 1 wherein Zn is less than 0.15 wt. %.

4. A method according to claim 1 wherein Zr is less than 0.05 wt. %.

5. A method according to claim 1 wherein cold rolling is with a cold roll reduction in a range of 5% to 8%.

6. A method according to claim 1 wherein stretching is with a permanent elongation in the direction of stretching in a range of 0.9% to 3%.

7. A method according to claim 1 wherein the final thickness is at least 4 inch.

8. A method according to claim 1 wherein the final thickness is from 4.5 inch to 8.5 inch.

9. An aluminum alloy plate having a final thickness of 3 inch or more obtained by the method of claim 1 comprising, in weight percent:

Mg 4.0 to 5.2

Mn 0.4 to 1.0

Zn≤0.3

Zr≤0.3

Cr≤0.3

Ti≤0.3

Fe<0.50

Si<0.45

Cu<0.25 other elements and unavoidable impurities each <0.05 total <0.20 balance aluminum, wherein the sum of Mg and Mn content is from 4.70 to 5.50 wt. % and wherein at mid-thickness and in the longitudinal direction TYS and elongation A % are such that elongation A % is at least −0.6 TYS+39.

10. An aluminum alloy plate according to claim 9 wherein at mid-thickness and in the longitudinal direction TYS and elongation A % are such that elongation A % is at least −0.6 TYS+40, wherein TYS is provided in ksi.

11. An aluminum alloy plate according to claim 9 wherein in a H116 temper ASTM G66 rating is PB or better.

12. An aluminum alloy plate according to claim 9 wherein the Zn content is at least 0.15 wt. % and wherein in a H116 temper ASTM G66 rating is at least PA.

13. An aluminum alloy plate according to claim 9 wherein in a H128 temper it has an ASTM G67 weight loss less than 15 $mg/cm^2$.

14. A product comprising an aluminum alloy plate according to claim 9 as an armor plate in an armored vehicle.

15. A product comprising an aluminum alloy plate according to claim 9 as plate for marine construction.

16. A product comprising an aluminum alloy plate according to claim 9 having an elongation A % of at least 16.0%.

* * * * *